US007360987B2

(12) United States Patent
Arraitz et al.

(10) Patent No.: US 7,360,987 B2
(45) Date of Patent: Apr. 22, 2008

(54) STATOR OF A HIGH-PRESSURE TURBINE OF A TURBOMACHINE, AND A METHOD OF ASSEMBLING IT

(75) Inventors: Anne-Marie Arraitz, Nandy (FR); Thierry Fachat, Moissy Cramayel (FR); Jerome Friedel, Blandy les Tours (FR); Alain Gendraud, Vernou la Celle S/Seine (FR); Delphine Roussin, Antony (FR)

(73) Assignee: Snecma, Paris (FR)

( * ) Notice: Subject to any disclaimer, the term of this patent is extended or adjusted under 35 U.S.C. 154(b) by 583 days.

(21) Appl. No.: 11/072,280

(22) Filed: Mar. 7, 2005

(65) Prior Publication Data

US 2005/0238477 A1 Oct. 27, 2005

(30) Foreign Application Priority Data

Mar. 18, 2004 (FR) ..... 04 02825

(51) Int. Cl.
*F01D 9/06* (2006.01)

(52) U.S. Cl. ..... 415/116; 415/173.2; 415/174.1; 415/220

(58) Field of Classification Search ..... 415/116, 415/144, 173.2, 174.1, 220; 60/806
See application file for complete search history.

(56) References Cited

U.S. PATENT DOCUMENTS 3,146,992 A 9/1964 Farrell
5,100,291 A * 3/1992 Glover ..... 415/115
5,205,115 A * 4/1993 Plemmons et al. ..... 60/806
5,281,085 A * 1/1994 Lenahan et al. ..... 415/116
2004/0018084 A1 1/2004 Halliwell et al.

FOREIGN PATENT DOCUMENTS

| | | |
|---|---|---|
| EP | 0 892 152 A1 | 1/1999 |
| EP | 0 892 153 A1 | 1/1999 |
| EP | 1 205 637 A1 | 5/2002 |
| EP | 1 258 599 A2 | 11/2002 |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A method of assembling sectored elements of an annular stator of a high-pressure turbine of a turbomachine about a longitudinal axis of said turbine, in which method an angular distribution pattern is defined for distributing elements of the stator over a predetermined angular sector, said pattern being defined so as to prevent inter-sector zones of stator elements being in radial alignment, said zones being defined between two adjacent sectors of the same stator element, and so as to repeat said distribution pattern around the entire circumference of the stator.

10 Claims, 4 Drawing Sheets

STATOR OF A HIGH-PRESSURE TURBINE OF A TURBOMACHINE, AND A METHOD OF ASSEMBLING IT

BACKGROUND OF THE INVENTION

The present invention refers to the general field of clearance tuning at the rotor blade tips in a high-pressure turbine of a turbomachine. More particularly, it provides an assembly method of assembling sectored elements that make up the stator of a high-pressure turbine of a turbomachine.

A stator in a high-pressure turbine of a turbomachine mainly comprises an annular casing disposed about a longitudinal axis of the turbine, a plurality of sectored spacers mounted on the casing, and a plurality of ring segments secured to the spacers, which ring segments form a circular surface surrounding the blades of a turbine rotor.

In order to increase the efficiency of such a turbine, it is known that it is necessary for clearance existing between the tips of the turbine rotor blades and those portions of the stator that face said tips to be as small as possible.

Clearance at the blade tips is reduced by varying the diameter of the casing of the turbine depending on its operating speed. Generally, annular pipes of the turbine stator are disposed around the casing, and air that is drawn from other portions of the turbomachine is passed through those pipes. Air is injected onto the casing, thereby causing the turbine stator to expand or contract thermally, which varies its diameter. The air flow pipes make up a unit for tuning clearance at the blade tips.

Existing blade tip clearance tuning units do not always make it possible to obtain great uniformity of temperature over the entire circumference of the turbine casing, thereby distorting the casing in a manner which is particularly detrimental to the efficiency and to the life time of the high-pressure turbine.

OBJECT AND SUMMARY OF THE INVENTION

The present invention therefore aims to mitigate such drawbacks by providing a method of assembling sectored elements of an annular stator of a high-pressure turbine, which method makes it possible to tune clearance at the blade tips with thermal distortion that is as small as possible and in any event that is repetitive.

To this end, the invention provides a method of assembling sectored elements of an annular stator of a high-pressure turbine of a turbomachine about a longitudinal axis of said turbine, said method consisting in defining an angular distribution pattern for distributing elements of the stator over a predetermined angular sector, said distribution pattern being defined so as to prevent the inter-sector zones of stator elements defined between two adjacent sectors of a single element of the stator being in radial alignment, and in repeating said distribution pattern around the entire circumference of the stator.

Preferably, the angular distribution pattern is repeated symmetrically in rotation relative to the predetermined angular sector.

When the elements of the stator consist of an annular casing, of a plurality of sectored spacers onto which a plurality of ring sectors are secured, said ring sectors forming a continuous circular surface encompassing the rotor blades of a turbine rotor, and of a plurality of angular air flow duct sectors designed to discharge air onto the casing in order to enable clearance at the tips of the high-pressure turbine rotor blades to be tuned, the angular distribution pattern of the stator elements is advantageously defined so as to prevent the inter-spacer zones defined between two adjacent spacers being in radial alignment with the duct inter-sector zones defined between two adjacent duct sectors.

In that manner, the casing zones, onto which air is not discharged by the air flow duct sectors, are prevented from aligning radially with inter-spacer zones. The temperature of the casing being distributed in a uniform manner over the predetermined angular sector, the resultant thermal distortion is thus also uniform.

Moreover, when the angular distribution is repeated symmetrically, the temperature of the casing is distributed symmetrically around the entire circumference of said casing. The result is that thermal distortion of the casing is substantially repetitive which makes it easier to control it.

When the stator elements further consist of a plurality of air supply inlets disposed through the casing and designed to supply air to a stage of a low-pressure distributor of the turbomachine, said stage being disposed downstream from the high-pressure turbine, the method further consists in aligning each air supply inlet radially with a duct inter-sector zone.

Preferably, the predetermined angular sector corresponds to an angular air flow duct sector. Moreover, three spacers and one air supply inlet are advantageously associated with each angular air flow duct sector.

The invention also provides a high-pressure turbine stator with an angular distribution of sectored elements such that it results in weak and repetitive thermal distortion.

The high-pressure turbine stator is wherein the stator elements are distributed angularly about the longitudinal axis of the high-pressure turbine so as to prevent the inter-spacer zones defined between two adjacent spacers being in radial alignment with the duct inter-sector zones defined between two adjacent duct sectors.

Preferably the stator elements are distributed angularly about the longitudinal axis of the high-pressure turbine, so as also to cause each air supply inlet to be in radial alignment with a duct inter-sector zone.

Advantageously, the stator has N angular air flow duct sectors, 3N spacers, N air supply inlets and 6N ring sectors.

BRIEF DESCRIPTION OF THE DRAWINGS

Other characteristics and advantages of the present invention appear from the description below, given with reference to the accompanying drawings which show a non-limiting embodiment. In the figures.

DETAILED DESCRIPTION OF THE EMBODIMENT

Figure 1:
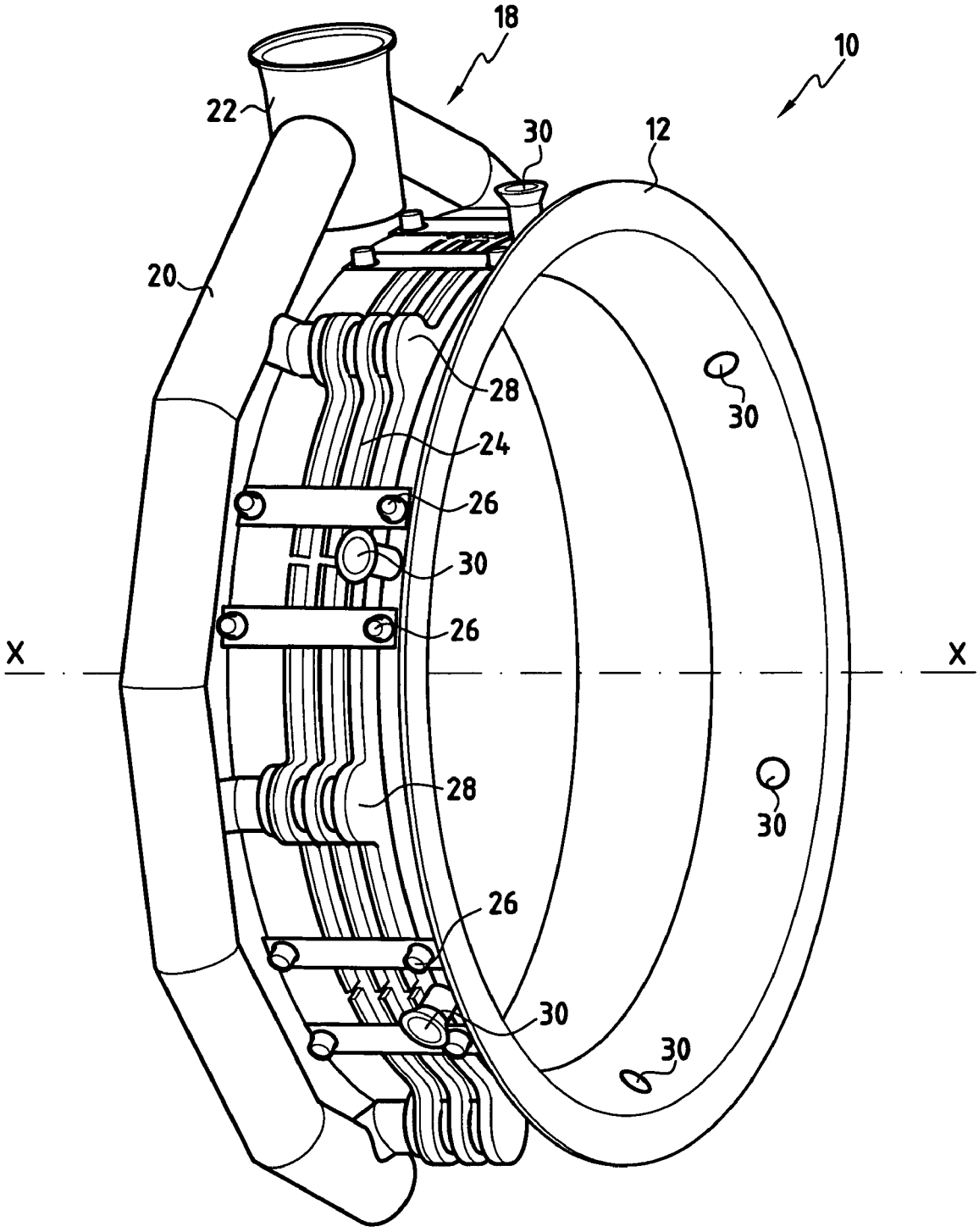
FIG. 1 is a perspective view showing a high-pressure turbine stator in accordance with the invention.

A stator 10 of a high-pressure turbine includes an annular casing 12 disposed about a longitudinal axis X-X of a high-pressure turbine.

On the inner surface of the annular casing 12, there are mounted a plurality of sectored spacers 14 disposed circumferentially about the longitudinal axis X-X of said turbine. In the description, the term "sectored" is used of elements to mean that the designated elements come in the form of angular sectors which, when placed end to end, form an assembly that is annular.

Ring sectors 16 are secured to the inner surfaces of the spacers 14. Said ring sectors 16 are disposed circumferentially about the longitudinal axis X-X of the turbine and form a continuous circular surface encompassing the blades (not shown in the figures) of a rotor (not shown) of the high-pressure turbine.

The inner surface of the ring sectors 16 defines a portion of the channel for gas coming from the combustion chamber (not shown) of the turbomachine and passing through the high-pressure turbine.

Clearance (not shown) is left between the inner surface of the ring sectors 16 and the tips of the rotor blades of the turbine rotor in order to allow said rotor blades to rotate.

In order to increase the efficiency of the turbine, it is necessary for said clearance to be as small as possible. For this purpose, a clearance control device 18 is provided. Said device consists, in particular, of a tubular air manifold 20 disposed around the casing 12 and supplied with air by at least one supply pipe 22 (only one supply pipe is shown in FIG. 1).

The tubular air manifold 20 supplies a plurality of angular air flow duct sectors 24 with air, said ducts being secured circumferentially to the casing 12 by means of fastening strips 26. The air flow duct sectors 24 are supplied via airtight V-shaped collars 28 connected to the tubular air manifold 20.

In FIG. 1, each duct sector 24 consists of three air flow ducts spaced apart along the axis and substantially parallel to one another. Each of said ducts is perforated by a plurality of holes (not shown) which discharge air onto the casing 12 in order to modify its temperature.

Moreover, a plurality of air supply inlets 30 are disposed through the casing 12. Said inlets 30 are designed to supply a stage of a low-pressure distributor (not shown in the drawings) of the turbomachine with air, said stage being disposed downstream from the high-pressure turbine.

The invention provides a method of assembling said various elements of the turbine stator about its longitudinal axis X-X.

In the invention, said method consists in defining an angular distribution pattern for distributing the elements of the stator 10 over a predetermined angular sector $\psi$, and in repeating the pattern around the entire circumference of the stator.

The distribution pattern for distributing elements of the stator 10 over a predetermined angular sector $\Psi$ is defined so as to prevent inter-sector zones of stator elements being in radial alignment. The inter-sector zones are defined as those zones that are situated between two adjacent sectors of a single element of the stator.

The predetermined angular sector $\Psi$ is advantageously selected in order to correspond to one angular duct sector 24.

Figure 2:
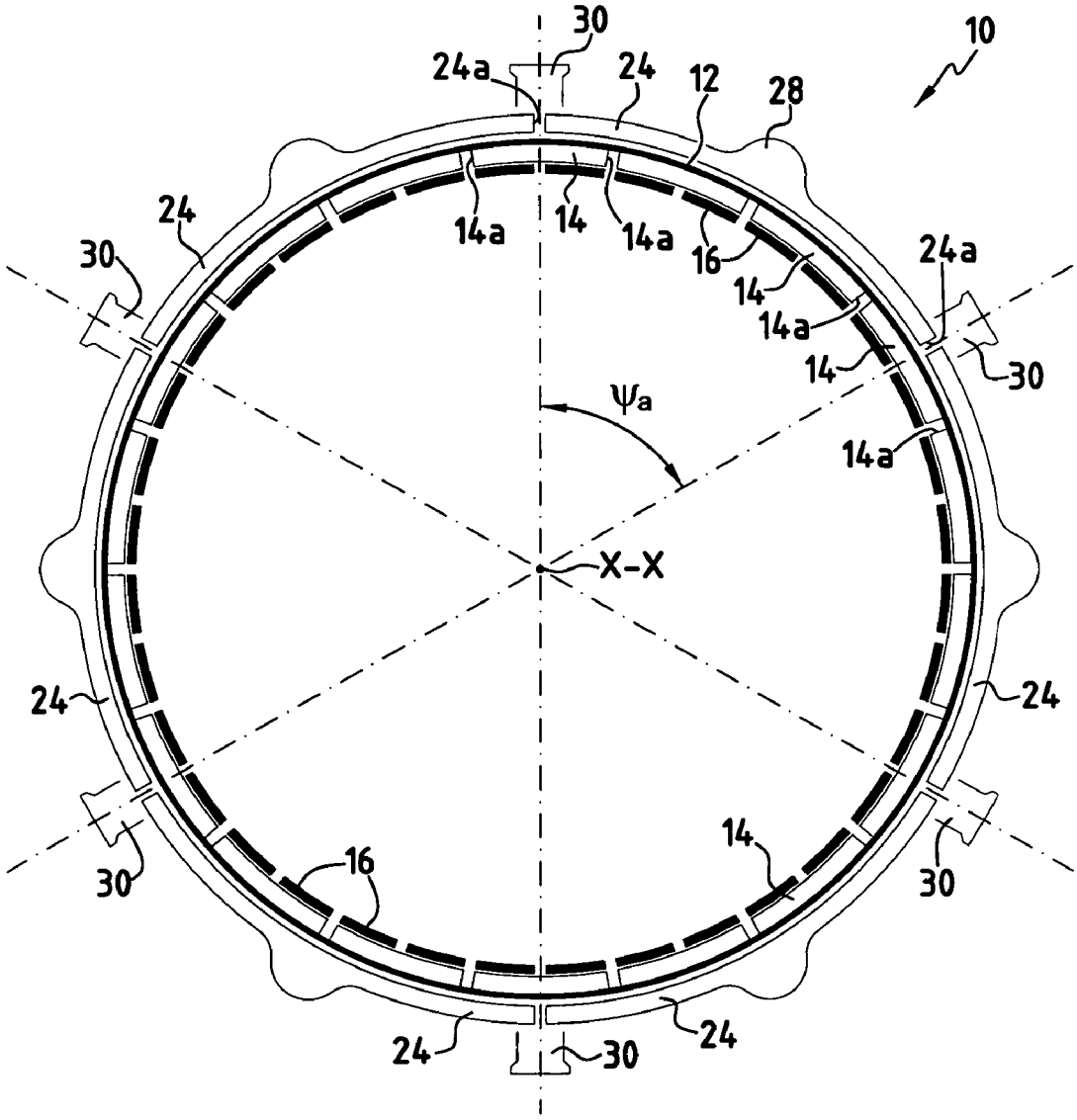
FIG. 2 is a diagrammatic cross-section view of the stator in FIG. 1.

FIG. 2 shows an embodiment of the method of the invention. In said figure, a 60° sector is selected as the predetermined angular sector $\Psi$a.

In said angular sector $\Psi$a, the elements of the stator 10 are disposed so as to prevent said inter-sector zones of stator elements being in radial alignment. More particularly, angular distribution is selected so as to prevent the inter-spacer zones 14*a* defined between two adjacent spacers 14 being in radial alignment with the duct inter-sector zones 24*a* defined between two adjacent duct sectors 24.

Such a distribution of spacers 14 relative to duct sectors 24 serves to prevent zones of the casing 12 onto which air is not discharged by the clearance control device 18 (i.e. in the vicinity of the duct inter-sector zones 24*a*) being in radial alignment with the inter-spacer zones 14*a*.

This ensures that casing 12 temperatures are distributed substantially uniformly over the angular sector $\Psi$a, and thus that the resulting thermal distortion is substantially uniform.

The distribution pattern thus defined for the angular sector $\Psi$ a is then repeated around the entire circumference of the stator 10. In the example in FIG. 1, the distribution pattern is repeated five more times in order to cover the entire circumference of the stator.

According to an advantageous characteristic of the invention, the distribution pattern is repeated around the entire circumference of the casing symmetrically in rotation relative to the predetermined angular sector $\Psi$a.

Thus, the temperature of the casing 12 is distributed symmetrically around the entire circumference of the casing. The result is that thermal distortion of the casing 12 is substantially repetitive which makes it easier to control.

According to another advantageous characteristic of the invention, the angular distribution pattern of the elements of the stator 10 in the predetermined angular sector is also defined so that each air supply inlet 30 is in radial alignment with a duct inter-sector zone 24*a*. Such a particular disposition of the air supply inlets 30 also contributes to improving temperature uniformity of the casing 12.

In FIG. 2, it can easily be observed that each inlet 30 designed to supply a stage of a low-pressure distributor with air is disposed between two adjacent duct sectors 24.

Figure 3:
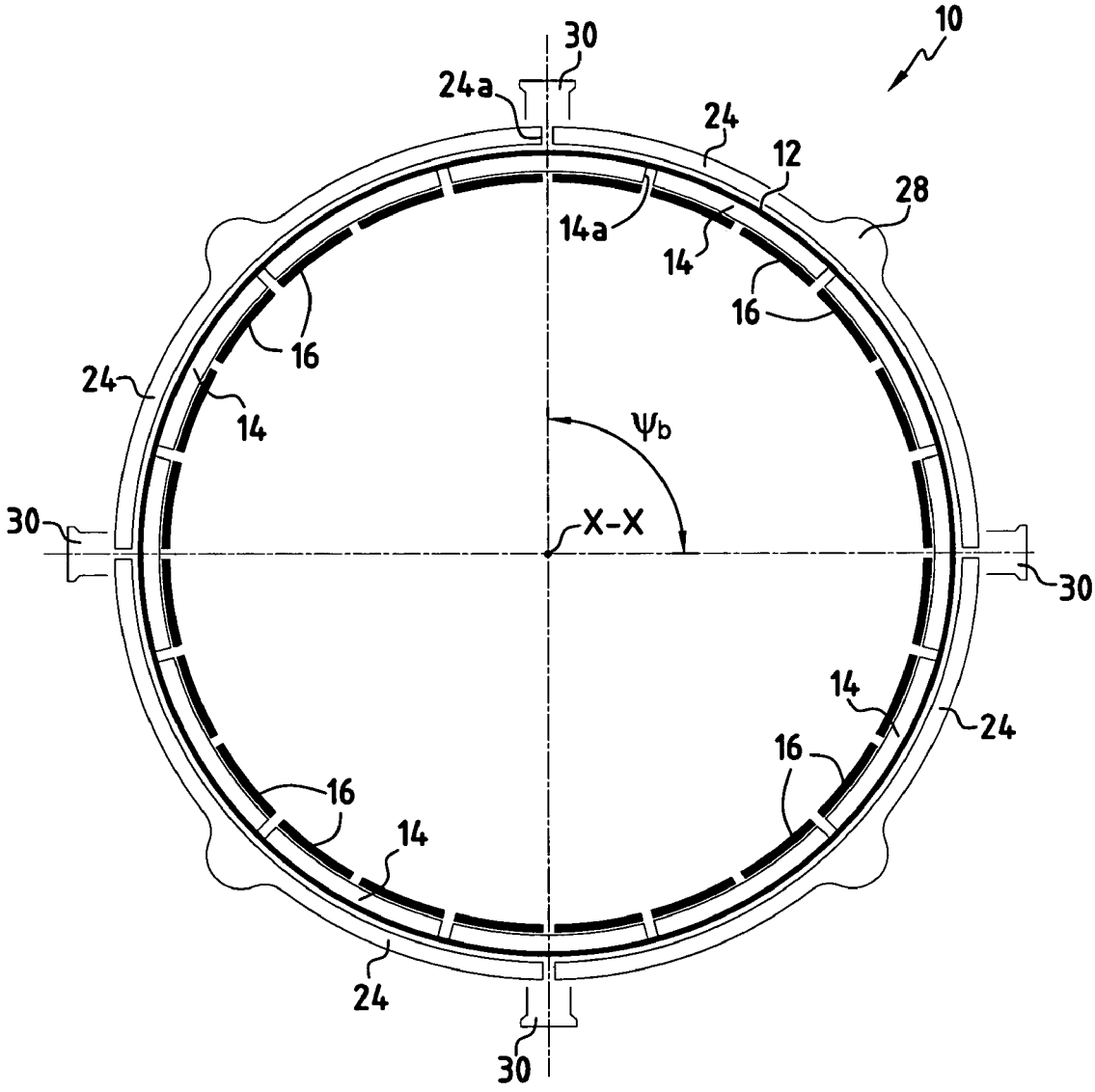
FIGS. 3 and 4 are diagrammatic cross-section views of stators, which views show other embodiments of the invention.

FIG. 3 shows another embodiment of the method of the invention. In this figure, a 90° sector is selected as the predetermined angular sector $\Psi$b. Said angular sector $\Psi$b corresponds to an angular duct sector 24.

In said angular sector $\Psi$b, the elements of the stator 10 are disposed, firstly, so as to prevent said inter-sector zones of stator elements being in radial alignment and, secondly, so as to cause each air supply inlet 30 to be in radial alignment with a duct inter-sector zone 24*a*.

Figure 4:
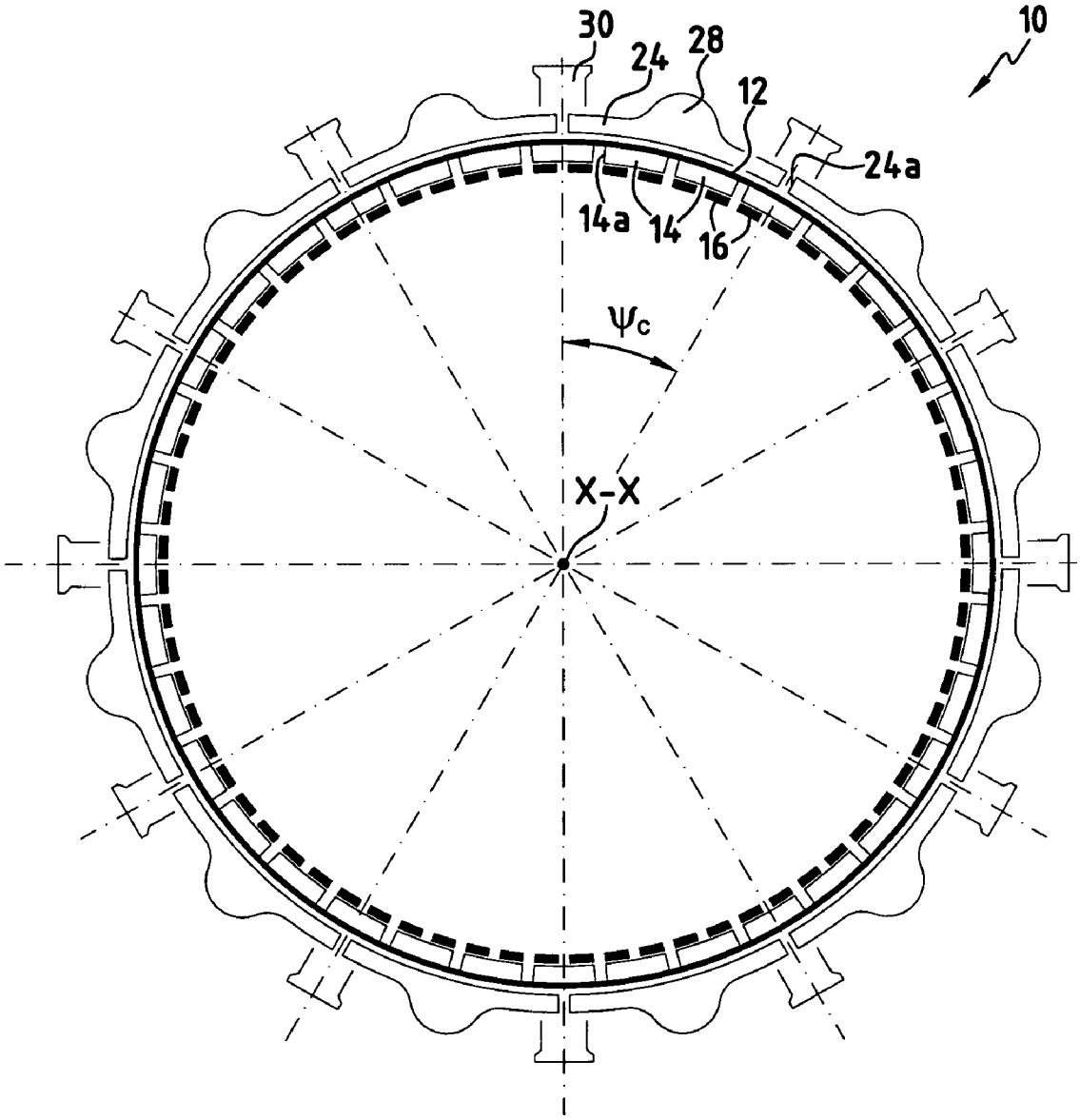

Said angular disposition is also satisfied by the stator in FIG. 4, which shows a further embodiment of the method of the invention. In said figure, a 30° sector is selected as the predetermined angular sector $\Psi$c corresponding to an angular duct sector 24.

According to another advantageous characteristic of the invention, provision is made for each angular air flow duct sector 24 to be associated with three spacers 14 and with one air supply inlet 30. Moreover, it is also advantageous for two ring sectors 16 to be associated with each spacer 14.

In other words, the high-pressure turbine stator 10 of the invention has N angular air flow duct sectors 24, 3N spacers 14, N air supply inlets 30, and 6N ring sectors 16.

Thus, the table below gives three configurations A, B, and C, which correspond respectively to the stator embodiments shown in FIGS. 2, 3, and 4. The table indicates the numbers of sectored elements for each of the configurations A, B, and C.

| | duct sectors 24 | spacers 14 | inlets 30 | ring sectors 16 |
|---|---|---|---|---|
| A, with N = 6 | 6 | 18 | 6 | 36 |
| B, with N = 4 | 4 | 12 | 4 | 24 |
| C, with N = 12 | 12 | 36 | 12 | 72 |

What is claimed is:

1. A method of assembling sectored elements of an annular stator of a high-pressure of a turbomachine about a longitudinal axis of said turbine, the stator comprising:

an annular casing disposed about the longitudinal axis of the high-pressure turbine;

a plurality of spacers that are sectored and mounted on the casing and onto which a plurality of ring sectors are secured, said ring sectors being disposed circumferentially about the longitudinal axis of the turbine so as to form a continuous circular surface encompassing the rotor blades of a turbine rotor; and a plurality of angular air flow duct sectors disposed circumferentially around the casing, and designed to discharge air onto the casing in order to enable clearance at the tips of the turbine rotor blades to be tuned;

said method consisting in:

defining an angular distribution pattern for distributing elements of the stator over a predetermined angular sector, said pattern being defined so as to prevent the inter-spacer zones defined between two adjacent spacers being in radial alignment with the duct inter-sector zones defined between two adjacent duct sectors; and in:

repeating said distribution pattern around the entire circumference of the stator.

2. A method according to claim 1, wherein the angular distribution pattern is repeated symmetrically in rotation relative to the predetermined angular sector.

3. A method according to claim 1, in which the stator elements further consist of a plurality of air supply inlets disposed through the casing and designed to supply air to a stage of a low-pressure distributor of the turbomachine, said stage being disposed downstream from the high-pressure turbine, said method further consisting in aligning each air supply inlet radially with a duct inter-sector zone.

4. A method according to claim 1, wherein an angular air flow duct sector corresponds to the predetermined angular sector.

5. A method according to claim 1, wherein three spacers and one air supply inlet are associated with each angular air flow duct sector.

6. A method according to claim 5, wherein two ring sectors are connected to each spacer.

7. A stator of a high-pressure turbine of a turbomachine comprising the following elements:

an annular casing disposed about a longitudinal axis of the high-pressure turbine;

a plurality of spacers that are sectored and mounted on the casing and onto which a plurality of ring sectors are secured, said ring sectors being disposed circumferentially about the longitudinal axis of the high-pressure turbine so as to form a continuous circular surface encompassing the rotor blades of a high-pressure turbine rotor;

a plurality of angular air flow duct sectors disposed circumferentially around the casing and designed to discharge air onto the casing in order to enable clearance at the tips of the high-pressure turbine rotor blades to be tuned; and a plurality of air supply inlets disposed through the casing and designed to supply air to a low-pressure distributor stage of the turbomachine, said stage being disposed downstream from the high-pressure turbine;

said stator being wherein the stator elements are distributed angularly about the longitudinal axis of the high-pressure turbine so as to prevent the inter-spacer zones defined between two adjacent spacers being in radial alignment with the duct inter-sector zones defined between two adjacent duct sectors.

8. A stator according to claim 7, wherein the stator elements are distributed angularly about the longitudinal axis of the high-pressure turbine, so as also to cause each air supply inlet 30 to be in radial alignment with a duct inter-sector zone.

9. A stator according to claim 7, having N angular air flow duct sectors, 3N spacers, and N air supply inlets.

10. A stator according to claim 9, having 6N ring sectors.

* * * * *